United States Patent [19]

Blakeney et al.

[11] 4,027,255

[45] May 31, 1977

[54] FAST RECOVERY TIME RECEIVER PROTECTOR FOR RADARS

[75] Inventors: Herbert K. Blakeney, Pasadena; Harry Goldie, Randallstown; Ronald W. Savoie, Laurel, all of Md.

[73] Assignee: Westinghouse Electric Corporation, Pittsburgh, Pa.

[22] Filed: Oct. 22, 1975

[21] Appl. No.: 624,622

[52] U.S. Cl. ..... 333/13; 315/39

[51] Int. Cl.[2] ..... H01P 1/14

[58] Field of Search ..... 333/13; 315/39; 325/24

[56] References Cited

UNITED STATES PATENTS

| | | | |
|---|---|---|---|
| 3,174,119 | 3/1965 | Jones et al. | 333/13 X |
| 3,521,197 | 7/1970 | Broderick | 333/13 |
| 3,577,028 | 5/1971 | Goldie | 333/13 X |
| 3,644,779 | 2/1972 | Goldie | 333/13 X |
| 3,705,319 | 12/1972 | Goldie et al. | 333/13 X |

*Primary Examiner*—Paul L. Gensler
*Attorney, Agent, or Firm*—F. L. Tolhurst

[57] ABSTRACT

The subject of the invention is a waveguide-type, multi-stage, receiver protector. It combines the use of all-chlorine gas discharge stages and a radioactive primer discharge stage having a semi-inert gas medium in a way to retain the protection benefits of the radioactive primer device, while providing the fast recovery time of the chlorine stages. The apparatus includes an r.f. limiting diode section which aids in attaining the combined benefits of the other two types of stages.

11 Claims, 6 Drawing Figures

80
56
T1
T2
T3
T4
T161
T162
DISCHARGE GAP ELECTRONS – TRITIUM PRIMED POWER LIMITED
58
62
DISCHARGE GAP ELECTRONS – OF TRITIUM PRIME STAGE
60
64
RESIDUAL ELECTRON DENSITIES IN CAPILLARY TUBE-TYPE CL2 LIMITER
TIME
V
n(e/cc)
10^15
10^6
n (e/cc)

FAST RECOVERY TIME RECEIVER PROTECTOR FOR RADARS

BACKGROUND OF THE INVENTION

The invention herein described was made in the course of or under a contract with the Department of the Air Force.

1. Field of the Invention

The present invention relates to receiver protectors for radar, and especially to receiver protectors for types of radar requiring a quick recovery period following the transmitted radar pulse, such as is the requirement in the case of pulse doppler radars.

2. Description of the Prior Art

Since the advent of the tritium primed power limiter device a method has been sought to eliminate the long recovery period of the device. The cause of this long recovery period is the fact that the tritium primer must be immersed in a semi-inert gas environment such as an admixture of argon (A), ammonia ($NH_3$), and water vapor ($H_2O$). The primers cannot survive when immersed in an attaching gas such as chlorine, which provides extremely short recovery times. On the other hand, an $A + NH_3 + H_2O$ gas fill yields a long recovery time and therefore degrades radar performance at short ranges.

One known approach for reducing the recovery time of tritium primed power limiters is the inclusion of water vapor in the admixture of semi-inert gases. An inherent disadvantage of doing this is that it raises the lower limit of the equipment's range of operating temperature. This is an important factor where the radar may be housed in structures which are subjected to extremely low temperatures, such as those installed in aircraft borne radomes.

SUMMARY OF THE INVENTION

A waveguide-type receiver protector is formed of three sections extending from the input to the output end of the waveguide. The first section has three chlorine gas power limiter stages of decreasing power extinguishing capabilities spaced apart one-quarter wavelength at the nominal center frequency of the waveguide, λg. The second section has a single tritium primed power limiter located one-quarter wavelength further along from the last chlorine stage. A third section has two r.f. limiting diodes operatively located at the shorted end of half wavelength stubs. The first of the stubs is connected to the waveguide at a point one-half wavelength from the tritium primed power limiter. The next stub is one-quarter of a wavelength from the first stub. When the limiting diodes are hard limited the first diode-stub limiter reflects a null back to the tritium primed power limiter. The extinguishing power capability of the last chlorine stage is so chosen that the power which passes therebeyond (i.e., not extinguished by earlier stages) and is subsequently null reflected by the diode-stub limiter to the tritium primed stage will during steady state operation be below the power level required to sustain the tritium primed stage. However, during the brief period of start-up the tritium primed stage is effective as a discharge state protecting the receiver.

DESCRIPTION OF THE PREFERRED EMBODIMENT

Figure 1:
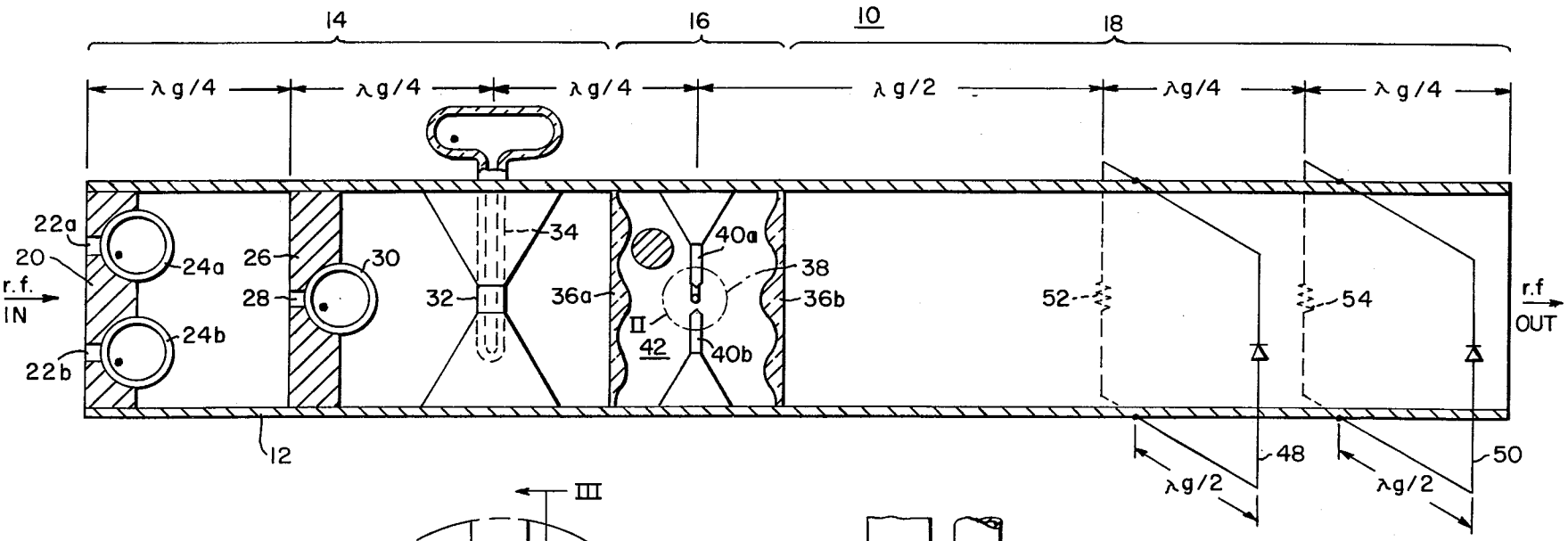
FIG. 1 is a conceptual drawing of a multi-stage, waveguide-type receiver protector constructed in accordance with the present invention.

Referring now to the drawing and in particular to FIG. 1 a multi-stage, waveguide-type receiver protector 10 comprises a rectangular cross-sectional waveguide 12 having an input end, indicated by the $r.f._{in}$ arrow and an output end indicated by the $r.f._{out}$ arrow. The r.f. input energy is conventionally introduced to the input end by an arrangement of the radar antenna connected to a circulator duplexer arrangement (not shown) having a "port 4" connection to the receiver circuit. Another port of the circulator is connected to the transmitter, and still another port to a suitable load for properly terminating impedances. The r.f. output is conventionally connected to another circulator connection arrangement (not shown) having one output port connected to the receiver and another output port connected to a suitable impedance termination load. Waveguide receiver protector 10 has three sequential linear sections disposed between its input and output end. These are: a chlorine gas stages section 14, a tritium primed stage or section 16, and an r.f. diode limiter section 18. Waveguide 12 has a characteristic center frequency, λg, for r.f. energy propagation. Except where otherwise identified all references to wavelength are to be understood to refer to electrical wavelength at frequency λg.

The r.f. inlet end of chlorine gas stages section 14 is provided with a metallic wall 20 containing a pair of slit-type irises **22*a*, 22*b*. A pair of vial-type chlorine gas discharge power limiters 24*a* and 24*b* are recessed in the rear side of wall 20 in alignment with the irises. An exemplary value of power rating of limiters 24*a*, 24*b* is that their combined characteristic minimum sustaining power is 400 watts. Minimum sustaining power is the minimum power to keep the discharge device stably turned on. Located at a position one-quarter wavelength further along in the direction of r.f. flow is another wall 26 having a single slit-type iris 28 and a single vial-type limiter 30 recessed in its rear face. An exemplary minimum sustaining power for limiter 30 is 80 watts. Limiters 24*a*, 24*b*, and 30 are a conventional type in which chlorine ($Cl_2$) is enclosed in a quartz vial, and preferably of the type further having a coating of radioactive primer material along the inside of the quartz enclosure. At a position another one-quarter wavelength further along the waveguide is disposed a thin tube, or so-called capillary tube-type chlorine gas power limiter. Limiter tube 32 extends within a central opening of a metallic double conical electrical field enhancer 34 with a portion of the tube midway between the wave guide walls exposed to the r.f. energy. The axes of capillary tube-type limiter 32 is perpendicular to the previous vial-type limiters 24***a*, 24*b* and 30. An exemplary power rating for capillary tube-type limiter 32 is 2.0 watts. Such a thin tube type limiters and electric field enhancing structures are conventional. While the preferred form of invention has chlorine gas limiters, it should be appreciated that limiters using other appropriate halogen gaseous mediums will also provide effective results. The common quality of chlorine and other appropriate halogen gaseous mediums is the existence of free electrons in their atomic structure, which gives them the desired property of quick extinction of the plasma gaseous discharge when the excess r.f. energy drops below their turn-off threshold. The turn-off threshold is somewhat lower than the rated sustaining power. The plasma gaseous discharge is the cause of the short circuiting of r.f. power which protects the receiver when the transmitter is keyed.

Figure 3:
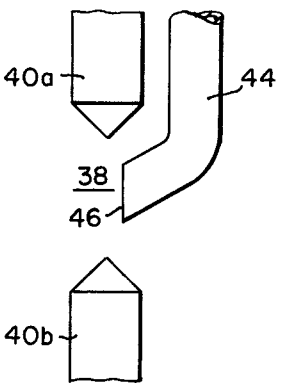
FIG. 3 is a section of FIG. 2 taken along line III—III.
Figure 2:
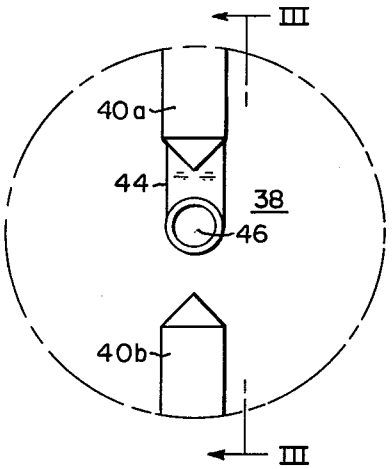
FIG. 2 is an enlargement of the portion of FIG. 1 within the phantom line circle II.

Tritium primed stage section 16 has hermetically sealed glass walls 36*a*, 36*b* forming a gas tight chamber therebetween. Located one-quarter wavelength along from the capillary tube-type chlorine limiter 32 is a discharge gap 38 formed between pointed electrodes 40*a*, 40*b*. The gas-tight chamber 42 contains a semi-inert gaseous medium (indicated by the cross-hatched circular symbol in FIG. 1). The semi-inert gaseous medium includes a noble gas from among the class of gases including argon and krypton. The gaseous medium is typically an admixture of argon (A), ammonia ($NH_3$), and water ($H_2O$). If desired, the $H_2O$ may be omitted in order to permit operation at lower temperatures. As shown in FIGS. 2 and 3 in conjunction with one another, a metallic rod 44, suitably fastened at its upper end (not shown) forms an end face 46 which confronts the discharge gap 38. End face 46 is coated with titanium tritide ($TiH_3$), which provides the radioactive priming. In accordance with conventional theory the basis of the priming action is the initiatory electrons available from the beta-ray emission from the $TiH_3$. The initiatory electrons are required for quick start-up of a plasma gaseous discharge across the gap. Stage or section 16 constitutes a tritium primed power limiter. An exemplary minimum sustaining power of stage 16 is of the range 0.2–0.8 watts, such a range being inherent to this type of device. It will be appreciated that the reason for use of a semi-inert gaseous medium in stage 16 is that halogen gases may not be used because their attaching nature would cause deterioration of the metallic structure associated with the discharge gap and support of the radioactive primer material. The qualities of the tritium primed power limiter which are exploited by the inclusion thereof in receiver protector assembly 10 are: (i) low firing power, (ii) adequate $TiH_3$ priming, (iii) large electric field enhancement, and (iv) very high reliability. Stage 16 is in and of itself conventional.

The r.f. diode limiter section 18 includes two limiter diode-half wave stub stages 48 and 50. In and of themselves, stages 48 and 50 are conventional. Diodes having desired r.f. "hard limiting" qualities are employed. The one-half wave stub arrangement is conventionally formed as a coaxial transmission line including an outer conductor and a central pintle (not shown) projecting from the waveguide. The diode forms a short circuit connection at the stub end. A conventional coaxial impedance matching structure (schematically depicted as impedance elements 52 and 54) is formed in the waveguide wall opposite diode and stub stages 48 and 50 respectively. The diode limiter circuit is conventionally completed by one side of the diode being grounded and the other connected through the coaxial pintle to a resistance which is connected to ground. Diode-stub stages 48 and 50 operate in a conventional manner to provide power limiting by the diodes being driven into their hard limiting state sequentially starting with stage 48. It is a characteristic of diode-stub stages that their power rating is extremely low, of the order of ½ milliwatt (−13 dBm) minimum sustaining power while the limiting level of the first diode-stub limiter 48 is of the order of 100 milliwatts (0.1 watt). In accordance with the present invention, stage 48 is disposed one-half wavelength along from the position of the discharge gap 38 of tritium primed stage 16. The effect of this location of stage 48 is to place the discharge gap at the point of a null in reflected energy from stage 48, so that stage 48 will appear to be limiting the r.f. flow to a much lower value than the 100 milliwatts, and therefore below the turn-off threshold of stage 16 in steady state operation. Stated another way, the location of diode-stub stage 48 at a one-half wavelength distance from discharge gap 38 effectively desensitizes the tritium primed stage section. Diode-stub stage 50 is located one-quarter wavelength from stage 48 where it provides another stage of hard limiting to limit the output power which passes out from receiver protector assembly 10 to acceptable limits. While stages 48 and 50 are disclosed as passive (i.e., self-actuating) power limiting stages, it will be appreciated by those skilled in the art that they could be d.c. or pulse gated just as well.

In the operation of receiver protector assembly 10 a high power r.f. pulse entering waveguide 12 will drive the diode-stub stages 48 and 50 into the non-linear regions of their diodes providing power limiting. The field reflected from stage 48 nulls the potential in the waveguide transverse plane of gap 38 of the tritium primed stage 16. This desensitizes the tritium primed stage and it begins to limit only at relatively high r.f. power levels. The three chlorine gas power limiter stages, which are desired to fire at 2, 80 and 400 watts, are sequentially excited in a rearward direction. Because of the highly attaching nature of $Cl_2$ gas, approximately 10 to 1,000 r.f. pulses are required before the $Cl_2$ limiter stages attain their repeatable steady state electron densities, $n(t)$, for each r.f. incident pulse. During this transient period the tritium primed stage provides deep limiting since the poor isolation of the $Cl_2$ stages cause very high r.f. power to be incident upon it. Thus adequate receiver protection (albeit poor recovery time) is assured during this 10 to 1,000 pulse time interval.

When a stable discharge exists in all $Cl_2$ stages the power which passes capillary tube-type limiter 32 in its saturation condition is insufficient to produce a sufficient reflected field from diode-stub stage 48 in the plane of discharge gap 38 to maintain the required sustaining power level for tritium primed stage 16. The gaseous discharge across discharge gap 38 will extinguish. The time elapsed from entrance of the first r.f. pulse to a stable discharge in all $Cl_2$ limiters is dependent on the electron carry-over between r.f. pulses (which will be amplified upon later in this paragraph), $Cl_2$ gas pressure, and discharge geometries. Thus the long term operation is without the tritium primed stage 16. The reason the tritium primed stage is not required for reliable operation after the initial start-up period is conceptually shown in the family of curves of FIGS.

Figures 4A, 4B, 4C:
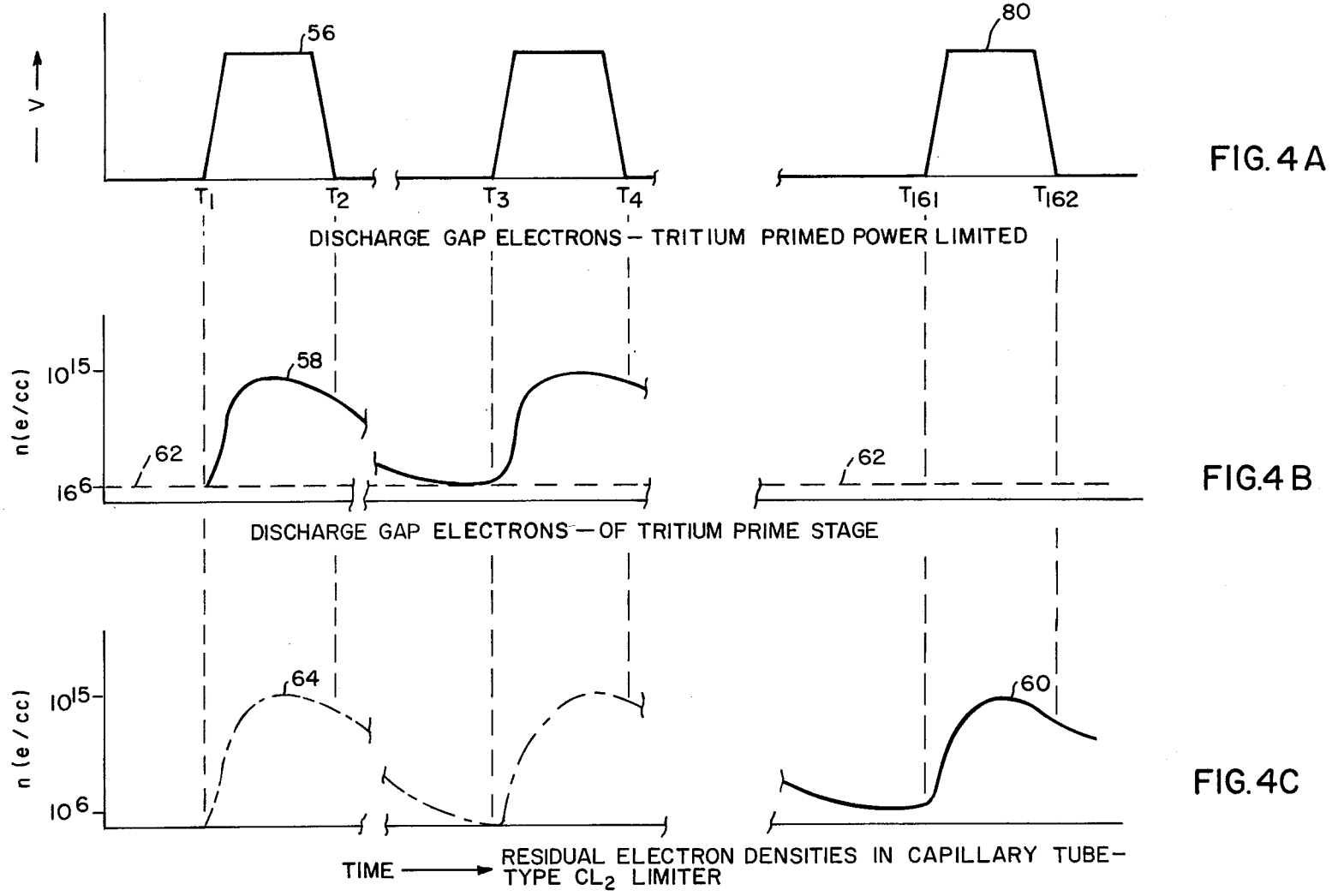
FIGS. 4A, 4B, and 4C are a family of curves which diagrammatically depict the relationship of available initiatory electrons in the tritium primed power limiter stage of FIG. 1 and the electron density carry-over of the last of the three chlorine power limiters of FIG. 1.

4A, 4B and 4C wherein: curve 56, FIG. 4A, is a series of pulses starting with the first pulse to enter waveguide 12 after transmitter startup; Curve 58, FIG. 4B represents the discharge gap electrons associated with operation of the tritium prime stage 16; and curve 60, FIG. 4C, represents the residual electron densities in the capillary tube-type $Cl_2$ limiter 32. During the initial period a discharge develops across the tritium primer stage gap 38 because the pressure of the $TiH_3$radioactive coating on face 46 of primer rod 44 supplies a constant level of initiatory electron density, represented by dashed line curve 62, FIG. 4B. At that time any transitory discharge through capillary tube-type limiter stage 32, schematically represented by phantom line curve 64, FIG. 4C, would have an electron carry over density beneath the threshold level. However, after a certain start-up period, which by way of example in the curves is indicated as the 80th pulse, the residual electron density following discharge through limiters 24*a* and 24*b* will increase to the point that the necessary initiatory electrons are carried over through interpulse interval so that limiter stage 32 discharges with each succeeding pulse. If the pulse rate frequency (P.R.F.) drops to a value so low that there are not enough carry-over electrons to reliably start the limiter stage 32, then the leakage power from limiters 24*a* and 24*b* increases to the point where the tritium primed limiter stage resumes active operation.

While distances between elements herein have been described as one-quarter wavelength ($\lambda_g/4$) or one-half wavelength ($\lambda_g/2$), it will be readily appreciated that any such specified interval may be respectively, an odd integral number or an integral number of such lengths, i.e., $(2N + 1)\ \lambda_g/4$, or $N\lambda_g/2$, where N is an integral number.

The principles of the present invention have been experimentally verified. For example, it has been found that using a high power incident pulse at a P.R.F. of 1 KHz, with 1 microsecond pulse width, at 2.9 GHz, the recovery time is reduced from about 1,200 nanoseconds for an assembly containing a tritium primed limiter device without the features disclosed herein, to 300 nanoseconds for an assembly built according to the present invention.

We claim as our invention:

1. A multiple-stage passive receiver protector for protecting a radar receiver from signals of the radar transmitter, said receiver protector comprising:

a. a waveguide having a predetermined center frequency characteristic $\lambda_g$, and having an r.f. energy input end and an r.f. energy output end, b. at least one halogen gas discharge stage disposed at a position in the r.f. energy input end of the waveguide, said halogen gas discharge stage having a short recovery period to permit the r.f. energy signals to pass to the receiver after the transmitter signal terminates, c. a rapid start-up gas discharge stage having a gas chamber including a metallic structure with a radioactive priming substance said rapid start-up gas discharge stage also including a semi-inert gaseous medium for protective immersion of the metallic structure therein, said rapid gas discharge stage being disposed at another position of the waveguide separated from said halogen gas discharge stage by a distance substantially equal to $(2N+1)\ \lambda_g/4$ where N is an integral number, said rapid start-up gas discharge stage having a sustaining threshold below the extinguishing power capability of said halogen gas discharge stage, said rapid start-up gas discharge stage having the characteristic of firing to protect the receiver from initial signals from the radar transmitter, and d. a first diode power limiter disposed in the waveguide in the direction of r.f. energy flow from said rapid gas discharge stage and spaced therefrom by a distance substantially equal to $N\lambda_g/2$, said first diode power limiter being operative to reflect a null back to said rapid gas discharge stage to cooperate with the operation of the rapid start-up gas discharge stage to cause it to effectively require a higher firing threshold than its normal firing threshold after an initial period following the action of r.f. power upon the first diode power limiter.

2. Apparatus in accordance with claim 1, wherein: the semi-inert gaseous medium of the rapid start-up gas discharge stage includes a noble gas from among the class of gases including argon and krypton.

3. Apparatus in accordance with claim 1, wherein: said rapid start-up gas discharge stage is of the tritiated primer type which includes:

means for establishing a zone of electric field enhancement, said zone of electric field enhancement being disposed within the gas chamber such that the radioactive priming substance of the metallic structure is disposed within the gas chamber adjacent to said zone of electric field enhancement.

4. Apparatus in accordance with claim 1, wherein: said first diode power limiter comprises a diode operatively connected to the waveguide at a distance substantially equal to $N\lambda_g/2$ from said rapid gas discharge stage by a stub line having a length substantially equal to $N\lambda_g 2$.

5. Apparatus in accordance with claim 1 further comprising a second diode power limiter at a waveguide position disposed in the downstream direction of r.f. energy flow from the position of said first diode power limiter and spaced therefrom by a distance substantially equal to $(2N+1)\ \lambda_g/4$.

6. A multiple stage receiver protector comprising:

a waveguide having a predetermined wavelength at the nominal center frequency, and having an r.f. energy input end and an r.f. energy output end;

at least one halogen gas stage disposed in the r.f. energy input end of the waveguide for limiting the power of the r.f. energy input signal to a predetermined level after achieving a steady state condition;

a tritium primed stage disposed in the waveguide at a distance from said halogen gas stage which is substantially an odd integral multiple of one-quarter of the predetermined wavelength at the nominal center frequency, in which the tritium primed stage provides power limiting of the r.f. input signal at power levels above a predetermined threshold; and a first diode power limiter disposed in the waveguide at a distance from said tritium primed stage which is substantially an integral multiple of one-half of the predetermined wavelength at the nominal center frequency, said first diode power limiter being operative to desensitize the tritium primed stage by providing a null condition in the r.f. signal at the location of the tritium primed stage such that the r.f. signal power which is required to provide the predetermined threshold necessary to sustain the tritium primed stage, exceeds the predetermined level of the output power of the halogen gas stage under steady state conditions whereby the power limiting of the tritium primed stage is extinguished when the halogen gas stage achieves a steady state condition.

7. The apparatus of claim 6 wherein said halogen gas stage and said tritium primed stage are characterized in that the power limiting condition of said tritium primed stage has a short response time in comparison to the response time for the power limiting condition of said halogen gas stage; and wherein said halogen gas stage has a relatively fast recovery time from said power limiting condition in comparison to the recovery time of said tritium primed stage from its power limiting condition such that the receiver protector has a power limiting condition with the faster response time for r.f. input signals which exceed the predetermined power level of said tritium primed stage, and the faster recovery from said power limiting condition for r.f. input signals causing the halogen gas stage to achieve steady state conditions.

8. The apparatus of claim 7 in which said tritium primed stage includes:

a radioactive priming substance; and means for enhancing the electric field of the r.f. input signal such that the radioactive priming substance is disposed in proximity to the electric field of the enhancing means.

9. A multiple stage receiver protector comprising:

a waveguide having a predetermined wavelength at the nominal center frequency, and having an r.f. energy input end and an r.f. energy output end;

at least one halogen gas stage disposed in the r.f. energy input end of the waveguide for limiting the power of the r.f. energy input signal to a predetermined level after achieving a steady state condition;

a tritium primed stage disposed in the waveguide at a distance from said halogen gas stage which is substantially one-quarter of the predetermined wavelength at the nominal center frequency, in which the tritium primed stage provides power limiting of the r.f. input signal at power levels above a predetermined threshold; and a first diode power limiter disposed in the waveguide at a distance from said tritium primed stage which is substantially one-half of the predetermined wavelength at the nominal center frequency, said first diode power limiter being operative to desensitize the tritium primed stage by providing a null condition in the r.f. signal at the location of the tritium primed stage such that the r.f. signal power which is required to provide the predetermined threshold necessary to sustain the tritium primed stage, exceeds the predetermined level of the output power of the halogen gas stage under steady state conditions whereby the power limiting of the tritium primed stage is extinguished when the halogen gas stage achieves a steady state condition.

10. The apparatus of claim 9 wherein said halogen gas stage and said tritium primed stage are characterized in that the power limiting condition of said tritium primed stage has a short response time in comparison to the response time for the power limiting condition of said halogen stage; and wherein said halogen gas stage has a relatively fast recovery time from said power limiting condition in comparison to the recovery time of said tritium primed stage from its power limiting condition such that the receiver protector has a power limiting condition with the faster response time for r.f. input signals which exceed the predetermined power level of said tritium primed stage, and has the faster recovery time from the power limiting condition for r.f. input signals causing the halogen gas stage to achieve steady state conditions.

11. The apparatus of claim 10 in which said tritium primed stage includes:

a radioactive priming substance; and means for enhancing the electric field of the r.f. input signal such that the radioactive priming substance is disposed in proximity to the electric field of the enhancing means.

* * * * *